US005947360A

United States Patent [19]

Frank

[11] Patent Number: 5,947,360

[45] Date of Patent: Sep. 7, 1999

[54] CUTTING BLADE FOR CUTTING SHEET MATERIALS

[75] Inventor: Armin C. Frank, Wyndmoor, Pa.

[73] Assignee: Metal Edge International, Inc., North Wales, Pa.

[21] Appl. No.: 08/826,894

[22] Filed: Apr. 9, 1997

Related U.S. Application Data

[63] Continuation-in-part of application No. PCT/US95/18923, Nov. 27, 1996

[60] Provisional application No. 60/007,854, Dec. 1, 1995, and provisional application No. 60/008,587, Dec. 13, 1995.

[51] Int. Cl.[6] ..... B26F 3/02

[52] U.S. Cl. ..... 225/39; 225/91

[58] Field of Search ..... 225/39, 41, 42, 225/43, 46, 47, 48, 49, 56, 77, 91, 92; 83/649, 660, 695; 30/358, 366

[56] References Cited

U.S. PATENT DOCUMENTS

| | | | |
|---|---|---|---|
| 1,939,812 | 12/1933 | Hamersely | 206/58 |
| 2,316,469 | 4/1943 | Thor | 206/58 |
| 2,766,877 | 10/1956 | Burbank | 206/58 |
| 2,771,186 | 11/1956 | Burbank | 206/58 |
| 2,820,281 | 1/1958 | Amsen | 29/78 |
| 3,147,658 | 9/1964 | Boyd | 83/660 X |
| 3,295,735 | 1/1967 | Lincoln | 225/91 X |
| 3,567,087 | 3/1971 | Schramm | 255/43 |
| 4,005,809 | 2/1977 | Finn | 225/49 |
| 4,196,647 | 4/1980 | Fish | 83/649 X |
| 4,340,162 | 7/1982 | Heiman et al. | 225/48 |
| 4,346,829 | 8/1982 | Myers | 225/48 |
| 4,346,830 | 8/1982 | Hauser | 225/49 |
| 4,669,191 | 6/1987 | Schramm | 30/358 |
| 4,962,686 | 10/1990 | Boyd et al. | 83/678 |
| 4,972,984 | 11/1990 | Frank et al. | 225/20 |
| 4,998,656 | 3/1991 | Hurh | 225/47 |
| 5,067,222 | 11/1991 | Frank et al. | 29/411 |
| 5,386,751 | 2/1995 | Dylla et al. | 83/649 X |
| 5,634,580 | 6/1997 | Levy | 225/56 |

FOREIGN PATENT DOCUMENTS

| | | | |
|---|---|---|---|
| 5-51029 | 3/1993 | Japan . | |
| 710933 | 6/1954 | United Kingdom | 225/91 |
| 2095154 | 9/1982 | United Kingdom | 225/91 |

*Primary Examiner*—Eugenia A. Jones

*Attorney, Agent, or Firm*—Dann, Dorfman, Herrell and Skillman; Henry H. Skillman; Stephen H. Eland

[57] ABSTRACT

A cutting blade for cutting sheet materials such as plastic film or metal foil is provided. The cutting blade incorporates a row of cutting teeth (50) projecting from a flat surface between the surface's folded edges. The depth of cut of the cutting blade is limited by the height that the cutting teeth project from the flat surface. In addition, by spacing the cutting teeth sufficiently closely together, the cutting teeth provide a bearing surface sufficient to support human skin so that the cutting blade cuts plastic film and metal foil but does not easily puncture human skin.

18 Claims, 5 Drawing Sheets

CUTTING BLADE FOR CUTTING SHEET MATERIALS

RELATED APPLICATION

This application is a continuation-in-part of PCT Application No. PCT/US96/18923, filed Nov. 27, 1996, which claims the benefit of U.S. Provisional Application No. 60/007,854, filed Dec. 1, 1995, and U.S. Provisional Application No. 60/008,587, filed Dec. 13, 1995.

FIELD OF THE INVENTION

The present invention relates to cutting blades for cutting sheet materials. More specifically, the present invention relates to cutting blades used to cut plastic film or metallic foils that are dispensed from a roll.

BACKGROUND OF THE INVENTION

Plastic film and metal foil are widely used throughout the food industry to wrap or cover various food products. The film or foil is typically dispensed from a roll contained in a box. Whenever a piece of film or foil is required, the length of the film or foil is withdrawn from the box and cut to length by a cutting blade that is attached to the carton or to a cardboard insert placed in the front of the carton. The cutting blade commonly used for many years has been a thin metallic saw-toothed blade having cutting points extending along the exposed edge of the blade. Although the points of the cutting blade can nick or cut the user, the real risk to the user is due to the fact that the cutting blade is made of a thin strip of metal. Just as a piece of paper can cause a cut, a thin strip of metal, with or without saw-toothed points, can cut.

SUMMARY OF THE INVENTION

In accordance with the present invention, a cutting blade for cutting sheet materials is provided which reduces the risk of inadvertent cuts to the users. The cutting blade allows a user to withdraw a length of sheet material, such as plastic film or metal foil from a dispenser, and cut the film or foil to length without serious risk of injury to the user. The cutting blade has two parallel longitudinally elongated edges connected by a substantially flat surface. Two longitudinally-elongated fold lines extend along the edges, and a row of teeth project from the flat surface intermediate the edges, so that the row of teeth is parallel to the fold lines and separated from the edges of the blade.

In addition, a method for producing a coil of cutting blade blanks is also provided. The method allows the cutting blade blank to be mass produced and then rolled into a coil that protects the cutting teeth of the cutting blade blank and allows the blank to be more easily stored or transported and dispensed to a blade-forming machine which may also stake the blade to a carton or a cardboard insert. The method includes the step of providing a longitudinally-elongated band having two parallel edges, an upper surface and a lower surface. A row of teeth are formed on the band so that the teeth project from the upper surface intermediate the edges. In addition, a row of blade connectors is formed on the band so that the connectors project from the lower surface. One of the edges of the band is then folded downwardly from the upper surface, and the band is bent to form a spiral coil of overlapping convolutions.

BRIEF DESCRIPTION OF THE DRAWINGS

All of the objectives of the present invention are more fully set forth hereinafter with reference to the accompanying drawings in which like numbers represent features, wherein.

DETAILED DESCRIPTION OF THE PREFERRED EMBODIMENTS

Figure 1:
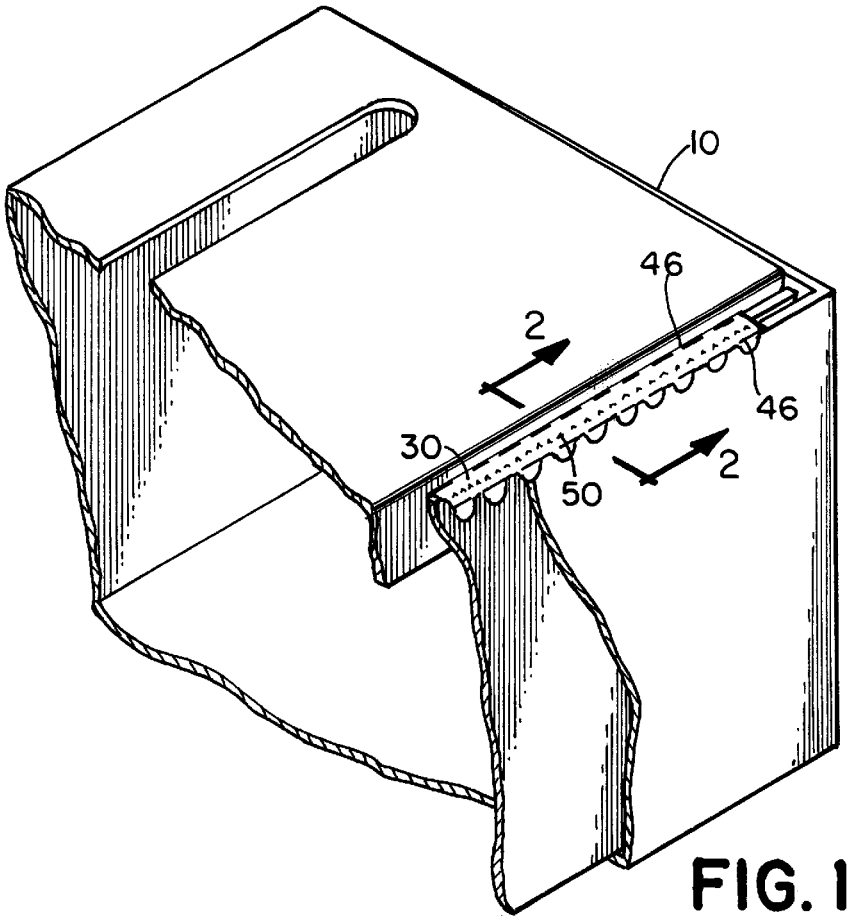
FIG. 1 is a fragmentary perspective view of a utting blade incorporating aspects of the present invention, shown in combination with a dispensing carton.
Figure 2:
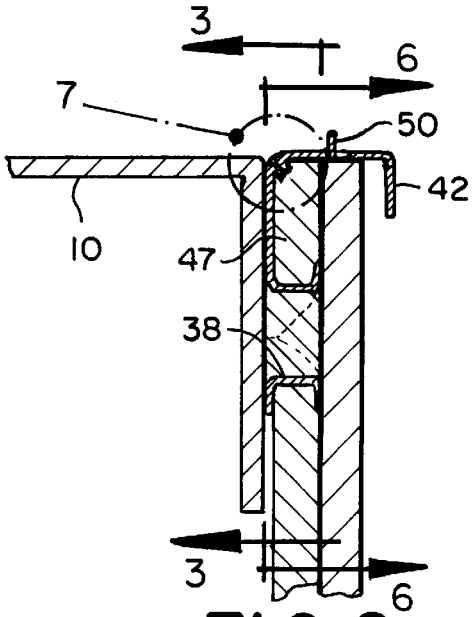
FIG. 2 is an enlarged fragmentary cross-sectional view of the dispensing carton shown in FIG. 1, taken along line 2—2.
Figure 3:
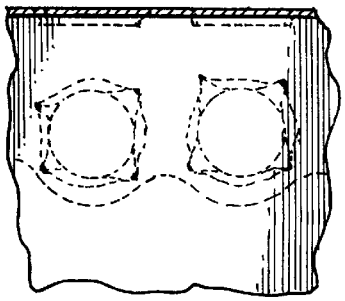
FIG. 3 is an enlarged fragmentary cross-sectional view of the carton shown in FIG. 2, taken along line 3—3.

Referring now to the drawings in general and FIG. 1 specifically, there is shown a cutting blade 30 used for cutting sheet materials such as plastic film or metal foil. In FIG. 1, the cutting blade 30 is shown in connection with a dispensing carton 10. A roll of plastic film or metal foil (not shown) is contained within the carton 10. The cutting blade 30 is shown connected to a cardboard insert 18 that is placed in the front of the carton 10. Alternatively, the cutting blade 30 can be attached directly to the carton 10. In operation, a user draws a length of the film or foil from the roll in the dispenser carton 10 and cuts the material to length by pulling the material downward over the cutting blade 30. To ensure that the entire width of the film or foil is cut, it is desirable for the cutting blade 30 to be at least as wide as the roll of film or foil in the dispenser carton.

Figure 8:
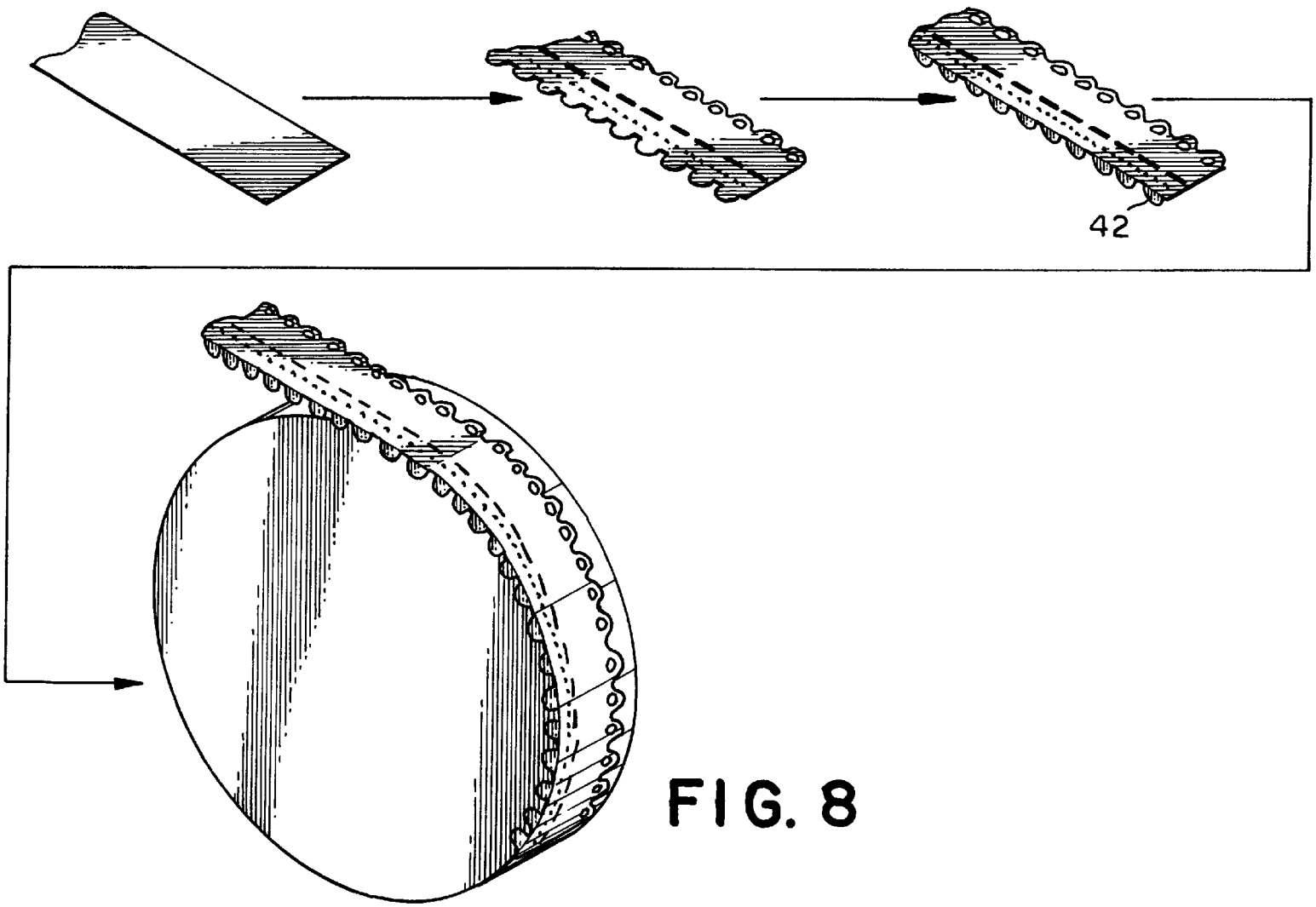
FIG. 8 is a diagrammatic view of the steps in the process for forming a coil of the cutter blade blanks in FIGS. 4–5.

The cutting blade 30 may be made from a continuous thin metal band. As shown in FIG. 8, the metal band is formed into a cutting blade blank 30*a*, which is illustrated in greater detail in FIGS. 4 and 5. After the blank is formed, one edge of the blank is bent, and the blank is then either rolled into a coil as shown in FIG. 8, or is cut to length, attached to a cardboard backing and bent again to form a cutting blade 30.

Figure 4:
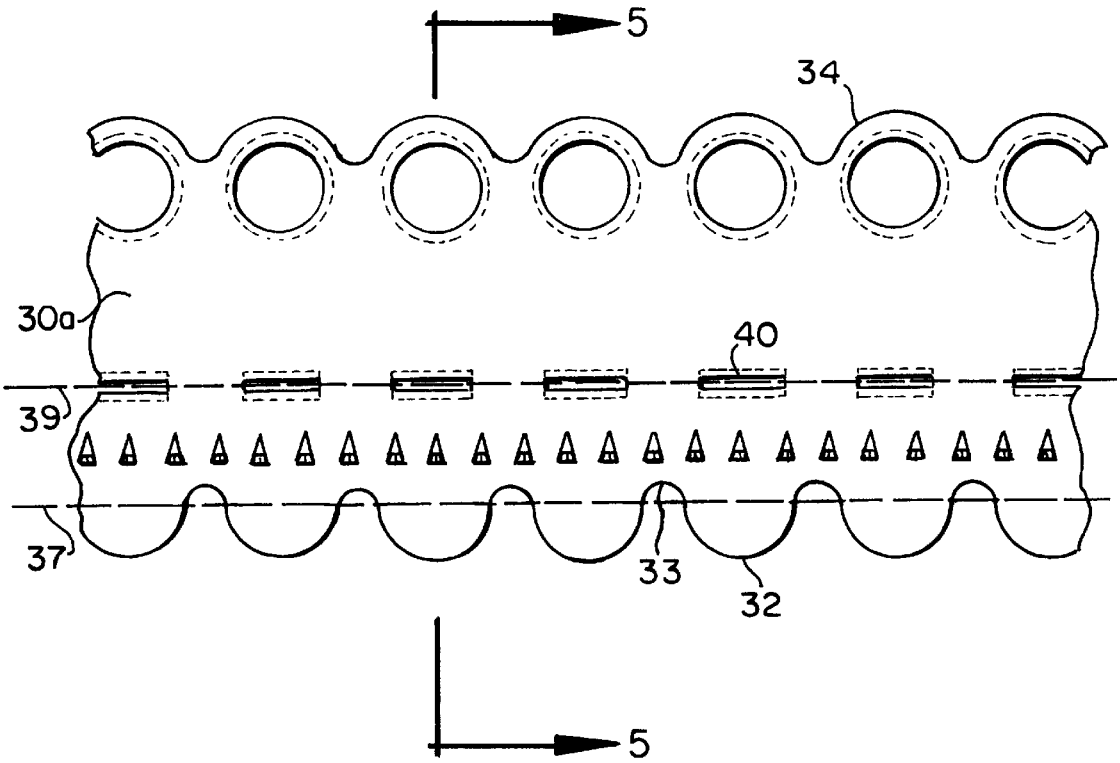
FIG. 4 is an enlarged fragmentary plan view of a cutting blade blank incorporating aspects of the present invention.
Figure 5:
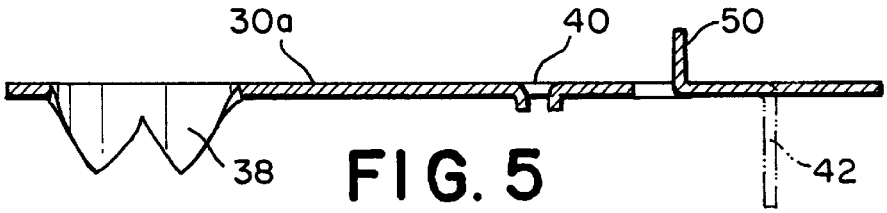
FIG. 5 is an enlarged fragmentary cross-sectional view of the cutting blade blank shown in FIG. 4, taken along line 5—5.
Figure 6:
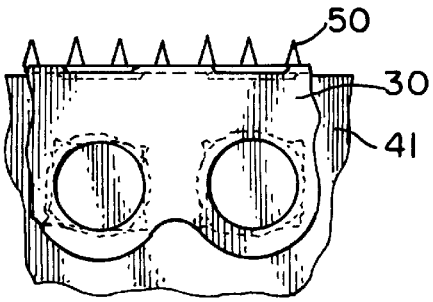
FIG. 6 is an enlarged fragmentary cross-sectional view of the cutting blade shown in FIG. 2, taken along line 6—6.

Referring to FIGS. 4 and 5, the cutting blade blank has two longitudinally elongated scalloped edges 32 and 34. The first scalloped edge 32 has a trough 33 between each scallop. The troughs 33 are longitudinally aligned forming a bend line 37, about which the cutting blade blank 30*a* is bent approximately 90° to form a scalloped flange 42, which is shown in phantom lines in FIG. 5. The second scalloped edge 34 has a series of circular stakes 38 punched from the scallops. The circular stakes 38 are formed by a circular piercing punch that bursts through the cutting blade blank 30*a* to deform the metal of the blank so that the circular stakes protrude from the lower surface of the blank. As will be discussed below further, the circular stakes 38 are used to attach the cutting blade blank 30*a* to a suitable backing.

Figure 9:
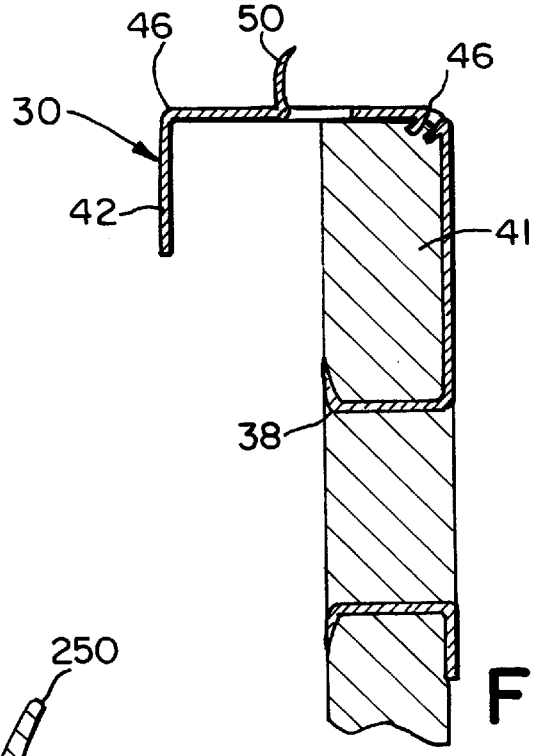
FIG. 9 is an enlarged fragmentary cross-sectional view of the cardboard insert removed from the carton, having a cutting blade, as seen from the back of FIG. 2.

The cutting blade blank 30*a* also includes a row of slots 40 parallel to the first bend line 37 formed by the troughs 33 in the first scalloped edge 32. The row of slots 40 creates a second bend line 39 about which the cutting blade blank 30*a* is bent to produce a channel in the cutting blade 30 as is discussed further below. A plurality of cutting teeth 50 are punched through the cutting blade blank to create a row of triangular cutout teeth parallel to the two bend lines 37 and 39. The cutting teeth 50 may be straight as shown in FIG. 5; however, in the preferred embodiments, the teeth are curved as shown in FIG. 9.

It may be desirable to create a bulk coil of the cutting blade blank 30*a* that is shown in FIG. 4. By coiling the cutting blade blank, the cutting blade blank 30*a* can be produced in high volume and more easily stored or transported and dispensed to a blade-forming machine which creates the fold line 39 and attaches the blade to a suitable substrate. However, as most clearly seen in FIG. 5, the circular stakes 38 project from the lower surface of the blank, and the cutting teeth 50 project from the upper surface of the blank. Therefore, the blank will not roll evenly to form a spiral coil. In addition, each successive convolution in the coil will rest upon the teeth 50 in the preceding convolution of the coil, which can cause damage to the teeth. To overcome these problems, the blank is bent along the first bend line 37 to create the scalloped flange 42 before the blank is rolled into a coil. As shown in FIG. 5, the flange 42 and the circular stake 38 create a two-point contact so that the cutter blade blank can be rolled into a coil as shown in FIG. 8. In addition, the scalloped flange 42 and the circular stakes 38 preferably are greater in height than the cutting teeth 50, so that the two-point contact of the circular stakes and the flange protects the cutting teeth from contact with successive convolutions of the coil.

Figure 7:
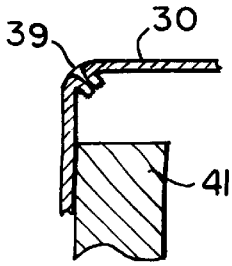
FIG. 7 is an enlarged fragmentary view of the portion of the cutting blade bounded by the circle designated 7 in FIG. 2, but mounted with its flat surface spaced above the top of the cardboard insert.

The further processing of the cutter blade blank 30*a* is similar regardless of whether the blank is rolled into a coil or not. After the blank is bent along the first bend line 37 to form the scalloped flange 42, the blank is cut to length. The blank is then bent along the second fold line 39 to form a finished cutting blade 30 and attached to a support substrate, such as corrugated cardboard or other paper board. For production efficiency, it is desirable to attach the blank 30*a* to the support substrate before the blank is bent along fold line 39. Typically, bending the blank after the blank is attached to the support substrate would be hampered by the fact that the support substrate is easily deformable. Therefore, the support substrate will tend to bend or crush when bending the blank. However, in the present instance, the slots 40 that form the second bend line 39 reduce the stiffness of the blank along the second fold line. Therefore, the blank 30*a* will readily fold along the second fold line 39 after the blank is attached to the support substrate, without significantly crushing or deforming the support substrate. As shown in FIG. 7, the flat surface of the blade 30 between the bend lines 37 and 39 may be spaced above the top of the cardboard insert 41 to afford insertion of a bending support to facilitate bending the blank along the line 39.

In the present instance, the support substrate is corrugated cardboard which is positioned in the channel formed between the flanges, and the blank 30*a* is attached to the cardboard by pressing the circular stakes 38 into the cardboard. As shown in FIG. 9, when the blank is attached to the cardboard 41, the circular stakes 38 are deformed to flare radially outwardly. Once the blank 30*a* is attached to the cardboard 41, the blank is bent along the second bend line 39 to form a channel-shaped cutting blade 30 as shown in FIG. 9.

Referring now to FIGS. 4 and 9, the cutting blade 30 comprises an aligned row of cutting teeth 50. The two bend lines 37 and 39 along which the cutter blade blank 30*a* was bent, form two longitudinally-elongated edges 46. Between the two edges 46, the upper surface 44 of the cutting blade 30 is flat except for the row of teeth 50 projecting from the upper surface. Because the cutting teeth 50 project from a flat surface, the cutting teeth 50 will only cut as deep as the height that the cutting teeth project from the flat surface 44. Therefore, to limit the depth of a potential cut to a user, the teeth 50 are preferably 0.015"–0.035" in height. In the present instance, the cutting teeth 50 project approximately 0.020" from the flat surface 44. In addition, the teeth 50 are closely spaced from one another to reduce the possibility of cutting a user.

If the cutting teeth are spaced sufficiently close to one another, the weight supported by any one tooth is insufficient to puncture the skin of the user. The result is similar to a bed of nails employed by fakirs. In the same way that the bed of nails are closely spaced so that the fakir can lie upon the bed of nails without puncturing his skin, if the teeth in the cutting blade are closely spaced, the risk of puncturing human skin is reduced. However, the cutting teeth must still be able to cut the plastic film or metal foil. Therefore, a satisfactory design will act like a fakir's bed of nails when in contact with the skin of the user, and also act like a cutting blade when the film or foil is pulled down over the cutting blade. This may be accomplished because plastic film is typically more elastic than human skin, thus being easily pulled down over the points of the cutting teeth and thereby cut. In addition, foil is typically much less elastic than human skin and thus easily tears when pulled down over the cutting teeth. To produce the bed of nails effect so that the cutting blade cuts the film or foil, and not human skin, the teeth 50 are preferably spaced apart longitudinally within the row of teeth so that there are approximately 12–22 teeth per inch. In the present instance, there are approximately 18 teeth per inch in the row of teeth. In addition, as shown in FIG. 9, although the teeth 50 are slightly curved, the teeth project substantially perpendicular to the flat surface 44. The bases of the triangular teeth are aligned generally parallel to the fold lines 37 and 39, so that the curved surfaces of the teeth cooperate to define an upstanding cutting edge which is also parallel to the fold lines.

Figure 10:
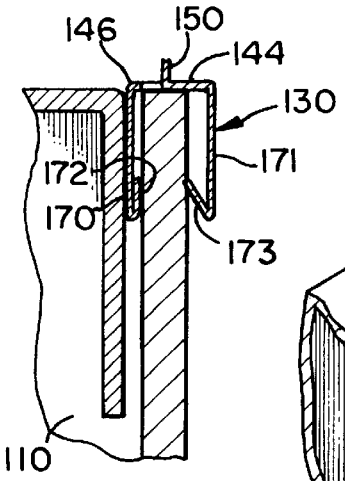
FIG. 10 is an enlarged fragmentary cross-sectional view of a dispenser carton having a second embodiment of a cutting blade.

Referring now to FIG. 10, a second embodiment of the improved cutting blade is illustrated. The cutting blade 130 illustrated in FIG. 10 is similar to the cutting blade illustrated in FIGS. 1–9, except the second embodiment is designed to be attached to the carton by the end users, rather than being attached by the manufacturer of the blade. Like the first embodiment, the second embodiment has a flat upper surface 144 between two longitudinally elongated edges or fold lines 146. A row of aligned teeth 150 configured and spaced similarly to the teeth described above project upwardly from the flat surface 144.

Two side flanges 170 and 171 extend downwardly from the edges 46. A lower extension of the side 170 is bent upwardly and inwardly upon itself, forming a reinforced edge 172. A lower extension of the flange 171 is bent upwardly and inwardly at an acute angle to the flange 171 to form a gripping flange 173, projecting angularly into the open-bottomed channel formed between the flanges 170 and 171. Configured in this way, the user can slip the cutting blade 130 over a support material, such as a piece of cardboard 141. Typically, the user will simply slip the cutting blade 130 over the front edge of a dispenser carton 110. The gripping flange 173 of the cutting blade 130 tends to grip the cardboard 141 so that the cutting blade 130 resists being removed from the cardboard. In addition, by bending back the lower extensions of the side flanges 170 and 171, the thin metal edges of the flanges are bent inward, thus eliminating the risk that the free edges of the flanges can inadvertently cut the user. The blade 130 may be supplied within a dispenser. When ready for use, the user simply engages a free edge of the dispenser within the channel formed between the flanges 170 and 171, and the gripping flange will retain the blade in place.

Figure 11:
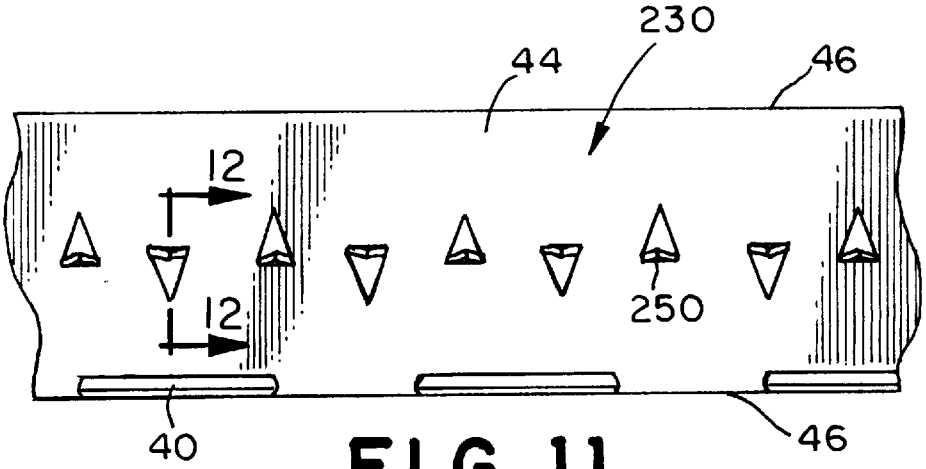
FIG. 11 is an enlarged fragmentary elevational plan view of a cutting blade incorporating a third embodiment of a cutting blade incorporating aspects of the present invention.
Figure 12:
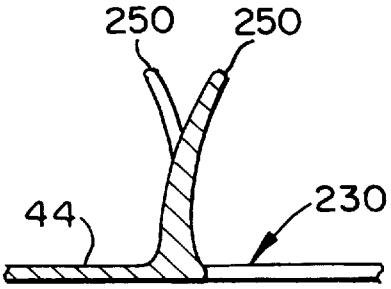
FIG. 12 is an enlarged fragmentary cross-sectional view of the cutting blade illustrated in FIG. 11, taken along line 12—12.

Referring now to FIGS. 11 and 12, a third embodiment of the improved cutting blade is illustrated. The cutting blade 230 illustrated in FIGS. 11 and 12 is similar to the cutting blade illustrated in FIGS. 1–9, except that the cutting teeth alternate in direction. As previously described and as illustrated in FIG. 9, the cutting teeth 50 are slightly curved or cupped. Because of this curvature, the cutting teeth cut better in one direction. For example, the cutting blade illustrated in FIG. 9 will cut film better if the film is pulled over the cutting blade from right to left and pulled downward to cut the film.

The cutting blade 230 illustrated in FIGS. 11 and 12 has alternating teeth 250 so that the cutting blade cuts equally well in both directions. The cutting teeth are spaced and configured similarly to the cutting teeth 50 illustrated in FIGS. 1–9 and described above, except that the teeth are punched out in alternating directions so that alternating triangular cutout teeth curve in opposing directions.

As shown in FIG. 11, the cutting blade 230 comprises a flat upper surface 244 extending between two longitudinally elongate edges 246. A row of teeth 250 projects from the flat surface intermediate the edges 246. The curvature of the teeth 250 results from the direction that the teeth 250 are punched through the cutting blade to form the triangular cutout components. Therefore, as can be more clearly seen in FIG. 11, the curvature of the teeth is alternated by alternating the direction that the cutting teeth are punched through the cutting blade. The teeth are generally triangular and their bases are aligned with each other and are disposed generally parallel to the fold line 246. Preferably, the longitudinal spacing between the bases of the teeth allows approximately 12–22 teeth per inch. The alternating cutting teeth 250 are aligned in a row, so that when viewed from the end, as shown in FIG. 12, the row of cutting teeth resembles the set in a conventional cross-cut saw blade. In this way, the cutting blade 230 cuts equally well regardless of the direction in which the film or foil is pulled over the cutting blade 230.

The cutting teeth 250 may alternate so that a plurality of adjacent teeth are curved in the same direction. For instance, the cutting teeth 250 may be configured so that two adjacent cutting teeth curve in one direction, and the next two adjacent cutting teeth curve in the opposite direction. However, in the present instance, the cutting teeth 250 alternate so that adjacent cutting teeth curve in opposite directions, as illustrated in FIG. 11.

Figure 13:
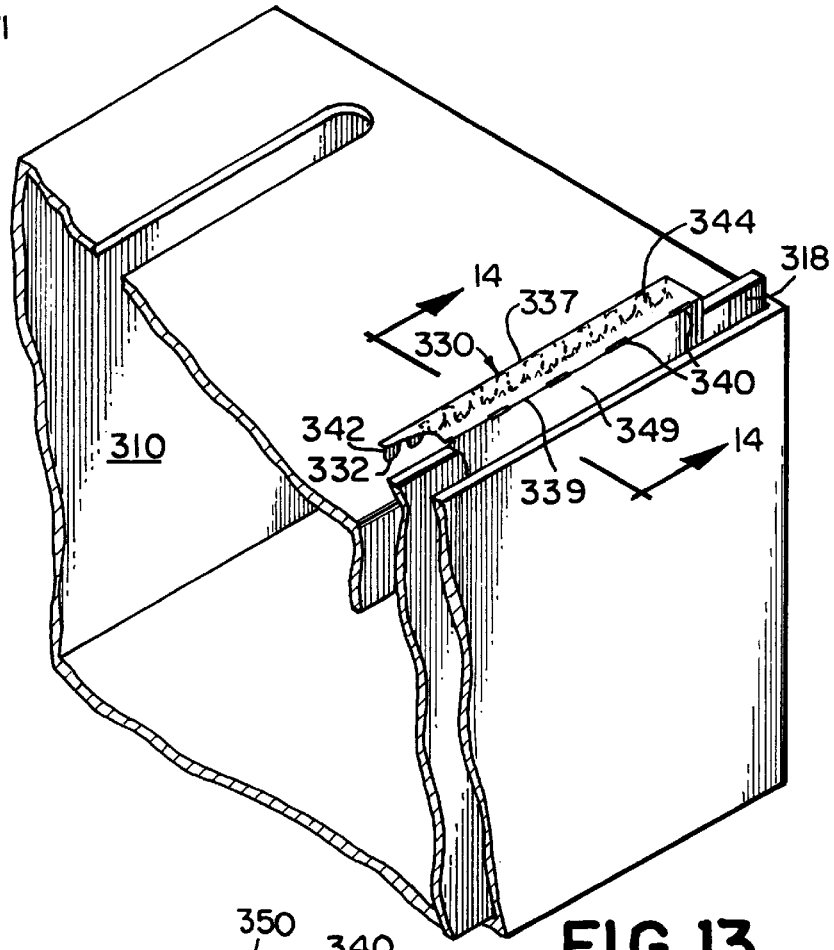
FIG. 13 is a fragmentary perspective view of another embodiment of a cutting blade incorporating aspects of the present invention, shown in combination with a dispensing carton.
Figure 14:
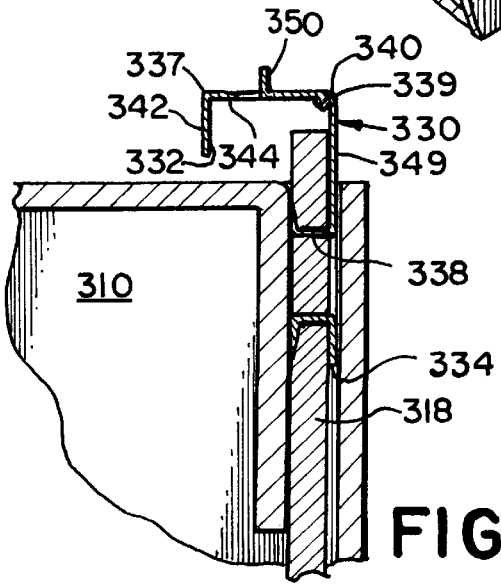
FIG. 14 is an enlarged fragmentary cross-sectional view of the dispensing carton shown in FIG. 13, taken a long line 14—14.

Referring now to the embodiment illustrated in FIGS. 13 and 14, a cutting blade 330 is shown in connection with a dispensing carton 310. The cutting blade 330 is shown connected to a cardboard insert 318 that is placed in the front of the carton 310.

The cutting blade 330 may be made from a continuous thin metal band, as described above in connection with the blade. The cutting blade blank has two longitudinally elongated scalloped edges 332 and 334. The first scalloped edge 332 forms a bend line 337, about which the cutting blade blank is bent approximately 90° to form a scalloped flange 342. The second scalloped edge 334 has a series of circular stakes 338 punched into the scallops. After the blank is bent along the first bend line 337 to form the scalloped flange 342, the blank is cut to length, and attached to the support substrate, in the present instance the carton insert 318. The blank is then bent along the second fold line 339 to bend down a staked flange 343 from the flat surface 344 in the finished cutting blade 330. For production efficiency, it is desirable to position the fold line 339 above the top of the substrate 318 to allow space for a tool used in bending the blank after the blank is attached to the support substrate.

The cutting blade also includes a row of slots 340 parallel to the first bend line 337. The row of slots 340 creates the second bend line 339 about which the cutting blade blank is bent to produce the support-receiving channel of the cutting blade 330. In this embodiment of the blade, the spacing between the slots 340 is greater than the spacing of the slots 40 in the blade 30, so that there is sufficient rigidity to support the flat surface 344 between the bend lines 337 and 339 cantilever-fashion by the staked flange 343 above the top of the panel 318.

A plurality of cutting teeth 350 are punched through the cutting blade blank to create a row of teeth between and parallel to the two bend lines 337 and 339.

While particular embodiments of the invention have been herein illustrated and described, it is not intended to limit the invention to such disclosures, but changes and modifications may be made therein and thereto within the scope of the following claims.

I claim:

1. A cutting blade for cutting sheet materials, comprising:

two spaced-apart parallel longitudinally-elongated edges;

a substantially flat surface connecting said edges;

two longitudinal fold lines extending along said edges, said fold lines defining two longitudinally-elongated flanges connected to said edges extending generally perpendicular to said flat surface below said surface to provide a channel shape, wherein each flange has a lower edge; and a row of teeth spaced from and parallel to said fold lines projecting above said flat surface intermediate said edges in a direction opposite to said flanges and generally parallel thereto, wherein each of said teeth consists of a cutout from said flat surface, formed as a single curved cutting component, adjacent teeth in said row being curved in opposing directions.

2. The cutting blade of claim 1 comprising two opposing inwardly-bent extensions at the lower edges of said flanges.

3. A device for cutting sheet materials, comprising:

a cutting blade, comprising:

two spaced-apart parallel longitudinally-elongated edges;

a substantially flat surface connecting said edges;

a row of longitudinally aligned teeth spaced from and intermediate said edges, each of said teeth being a single substantially triangular cutting component projecting above said flat surface perpendicular to said flat surface; and a plurality of holes formed in said flat surface adjacent the teeth wherein the number of holes corresponds to the number of teeth; and a container comprising a front face having a terminal edge extending along the length of the container, wherein the cutting blade is disposed so that the row of teeth is substantially parallel to the terminal edge of the front face.

4. The cutting blade of claim 3 comprising two longitudinal fold lines spaced from said row of teeth and defining said edges.

5. The cutting blade of claim 4 comprising a plurality of longitudinally-aligned slots in said flat surface along at least one of said fold lines.

6. The cutting blade of claim 3 comprising two longitudinally-elongated side flanges connected to said flat surface at said edges and extending perpendicularly downwardly from said flat surface to form a downwardly-open channel below said flat surface, wherein each flange has a lower edge.

7. The cutting blade of claim 6 comprising two opposing inwardly-bent flange extensions connected to the lower edges of said side flanges, at least one of said extensions being bent angularly upward at an acute angle to the associated side flange to constitute a gripping flange.

8. A cutting blade for cutting sheet materials, comprising:

two parallel longitudinally-elongated edges;

a substantially flat surface connecting said edges;

a row of teeth projecting above said flat surface intermediate said edges, said teeth comprising triangular components having bases disposed in a single line parallel to said edges, each component having an apex forming a single curved cutting component, with adjacent components in said row being curved in opposing directions.

9. The cutting blade of claim 8 comprising two longitudinal fold lines extending along said edges.

10. The cutting blade of claim 8 comprising two longitudinally-elongated side flanges connected to said flat surface by said fold lines, said side flanges depending below said flat surface to provide an open channel, wherein each flange has a lower edge.

11. The cutting blade of claim 10 comprising two opposing inwardly-bent flange extensions connected to the lower edges of said side flanges.

12. A device for cutting sheet materials, comprising:

a container for receiving a roll of sheet material having a width, wherein the container has a front face having a terminal edge at least as long as the width of the roll of material;

a longitudinally-elongated band comprising a planar web surface having two spaced-apart parallel longitudinally elongated edges;

a row of teeth integrally formed from said band, each of said teeth having a base and a projecting portion extending perpendicularly upwardly from said web surface in a line spaced from and intermediate said edges, wherein the projecting portion of each of said teeth projects approximately 0.015"–0.035" from said base, and said teeth bases are longitudinally aligned and spaced so that there are approximately 12–22 teeth per inch; and a plurality of holes formed in said planar web surface adjacent the teeth wherein the number of holes corresponds to the number of teeth;

wherein said band is disposed adjacent said terminal edge so that said row of teeth is substantially parallel to said terminal edge.

13. The device of claim 12 comprising two longitudinally-elongated side flanges connected to said planar web surface along said edges, said side flanges being substantially perpendicular to said planar web surface to form a downwardly open channel, wherein each flange has a lower edge.

14. The device of claim 13 comprising two opposing inwardly-bent flange extensions connected to the lower edges of said side flanges.

15. A device for cutting sheet materials, comprising:

a cutting blade comprising:

a longitudinally elongated band extending across substantially the width of the sheet material, comprising a generally planar web surface having two spaced-apart parallel longitudinally elongated edges;

a row of teeth integrally formed from the band, each of said teeth having a base and a projecting portion extending upwardly from the web surface spaced from said two edges of the band, wherein the teeth bases are longitudinally aligned;

a plurality of holes formed in said planar web surface adjacent the teeth wherein the number of holes corresponds to the number of teeth; and a container comprising a front face having a terminal edge extending along the length of the container, wherein the cutting blade is disposed so that the row of teeth is substantially parallel to the terminal edge of the front face.

16. The device of claim 15 wherein the teeth bases are substantially parallel to one of the two edges of the band.

17. The device of claim 15 wherein the cutting blade comprises a longitudinally elongated flange connected to one of the two edges of the band, extending transverse the web surface.

18. The device of claim 17 wherein the cutting blade comprises a second longitudinally elongated flange connected to the second of the two edges of the band, extending transverse the web surface to provide a channel shape.

* * * * *